US009863288B2

(12) United States Patent
Nagura et al.

(10) Patent No.: US 9,863,288 B2
(45) Date of Patent: Jan. 9, 2018

(54) VALVE OPENING AND CLOSING TIMING CONTROL DEVICE

(71) Applicant: AISIN SEIKI KABUSHIKI KAISHA, Kariya-shi, Aichi-ken (JP)

(72) Inventors: Kentaro Nagura, Paris (FR); Yugo Nakamura, Nagoya (JP); Hiromitsu Shigyo, Toyota (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 144 days.

(21) Appl. No.: 14/854,749

(22) Filed: Sep. 15, 2015

(65) Prior Publication Data

US 2016/0076408 A1 Mar. 17, 2016

(30) Foreign Application Priority Data

Sep. 16, 2014 (JP) ..... 2014-187809

(51) Int. Cl.
*F01L 1/344* (2006.01)
*F01L 1/34* (2006.01)

(52) U.S. Cl.
CPC ..... *F01L 1/34* (2013.01); *F01L 1/3442* (2013.01); *F01L 2001/3445* (2013.01); *F01L 2001/34426* (2013.01); *F01L 2001/34433* (2013.01)

(58) Field of Classification Search
CPC ... F01L 2001/34426; F01L 2001/34433; F01L 2001/3445
(Continued)

(56) References Cited

U.S. PATENT DOCUMENTS 8,726,866 B1 * 5/2014 Lichti ..... F01L 1/34 123/90.15
2005/0056249 A1 * 3/2005 Heinze ..... F01L 1/022 123/294
(Continued)

FOREIGN PATENT DOCUMENTS

DE 10 2012 208 812 A1 11/2013
EP 2 843 202 A1 3/2015
(Continued)

OTHER PUBLICATIONS

Extended European Search Report dated Feb. 5, 2016, issued by the European Patent Office in the corresponding European Application No. 15185315.7 (6 pages).

*Primary Examiner* — Jorge Leon, Jr.
(74) *Attorney, Agent, or Firm* — Buchanan Ingersoll & Rooney PC

(57) ABSTRACT

A valve opening and closing timing control device includes: a driving-side rotating body including a sprocket around which a rotating body interlocked with a driving shaft of an internal combustion engine is wound and rotates in synchronization with the driving shaft; a driven-side rotating body supported by an inside of the driving-side rotating body to be rotatable coaxially with the same rotational axis and integrally rotating with a valve opening and closing cam shaft; a bolt inserted into the driven-side rotating body to fix the driven-side rotating body to the cam shaft; a fluid pressure chamber formed by being partitioned between the driving-side and driven-side rotating bodies; and a control valve switching supplying and discharging of a hydraulic fluid with respect to the fluid pressure chamber such that a relative rotational phase of the driven-side rotating body with respect to the driving-side rotating body is changed.

5 Claims, 6 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 2008/0264200 | A1* | 10/2008 | Hoppe | F01L 1/34 74/568 R |
| 2012/0097122 | A1 | 4/2012 | Lichti | |
| 2012/0186547 | A1* | 7/2012 | Fujiyoshi | F01L 1/3442 123/90.17 |
| 2013/0199469 | A1* | 8/2013 | Busse | F16K 11/07 123/90.15 |
| 2013/0199475 | A1* | 8/2013 | Schafer | F01L 1/3442 123/90.17 |
| 2015/0059669 | A1 | 3/2015 | Yamakawa et al. | |
| 2015/0129066 | A1 | 5/2015 | Bayrakdar | |
| 2015/0267571 | A1 | 9/2015 | Kohler et al. | |

FOREIGN PATENT DOCUMENTS

| | | | |
|---|---|---|---|
| JP | 2009-515090 | A | 4/2009 |
| WO | WO 2007/051704 | A | 5/2007 |
| WO | 2014/059975 | A1 | 4/2014 |

* cited by examiner

VALVE OPENING AND CLOSING TIMING CONTROL DEVICE

CROSS REFERENCE TO RELATED APPLICATIONS

This application is based on and claims priority under 35 U.S.C. §119 to Japanese Patent Application 2014-187809, filed on Sep. 16, 2014, the entire contents of which are incorporated herein by reference.

TECHNICAL FIELD

This disclosure relates to a valve opening and closing timing control device having a driving-side rotating body that rotates in synchronization with a driving shaft of an internal combustion engine, a driven-side rotating body that integrally rotates with a valve opening and closing cam shaft of the internal combustion engine, and a control valve that changes a relative rotational phase of the driving-side rotating body and the driven-side rotating body.

BACKGROUND DISCUSSION

JP 2009-515090T discloses a technique related to the valve opening and closing timing control device.

The valve opening and closing timing control device includes a shaft portion in which a bolt that is inserted into the driven-side rotating body engages with the driven-side rotating body and the cam shaft coaxially with a rotational axis and a male screw section which engages with the cam shaft to fix the driven-side rotating body to the cam shaft.

The driving-side rotating body includes a sprocket around which an endless rotating body interlocked with a driving shaft of the internal combustion engine is wound. When the endless rotating body is rotated, the driving-side rotating body is pulled toward a driving shaft by driving the sprocket.

On the other hand, the driven-side rotating body is supported by an inside of the driving-side rotating body to be rotatable coaxially with the same rotational axis. Thus, if the driving-side rotating body is pulled toward the driving shaft, the driven-side rotating body is also pulled toward the driving shaft. The driven-side rotating body is fixed to the cam shaft by a bolt. Thus, if the driven-side rotating body is pulled toward the driving shaft, a bending force acts on the bolt.

The valve opening and closing timing control device of the related art is provided with an annular gap between an outer peripheral surface of the bolt and an inner peripheral surface of the cam shaft over an entirety of a region between the sprocket and the male screw section in a direction of the rotational axis. For example, the annular gap configures an annular flow path for supplying and discharging hydraulic fluid with respect to a fluid pressure chamber.

Thus, when the driven-side rotating body is pulled toward the driving shaft, in a region between the sprocket and the male screw section in the direction of the rotational axis, rigidity obtained in the bolt and the cam shaft is not sufficient and a deformation amount of the bolt and the cam shaft increases.

As a result, there is a concern that smooth rotation of the driving-side rotating body and the driven-side rotating body is deteriorated.

SUMMARY

Thus, a need exists for a valve opening and closing timing control device which is not susceptible to the drawback mentioned above.

In an aspect, a valve opening and closing timing control device according to this disclosure includes a driving-side rotating body that includes a sprocket around which a rotating body interlocked with a driving shaft of an internal combustion engine is wound and rotates in synchronization with the driving shaft; a driven-side rotating body that is supported by an inside of the driving-side rotating body to be rotatable coaxially with the same rotational axis and integrally rotates with a valve opening and closing cam shaft of the internal combustion engine; a bolt that is inserted into the driven-side rotating body to fix the driven-side rotating body to the cam shaft; a fluid pressure chamber that is formed by being partitioned between the driving-side rotating body and the driven-side rotating body; and a control valve that switches supplying and discharging of a hydraulic fluid with respect to the fluid pressure chamber such that a relative rotational phase of the driven-side rotating body with respect to the driving-side rotating body is changed between the most advance angle phase and the most retarded angle phase, in which the bolt includes a male screw section in which the bolt engages with the cam shaft, and an abutting section at which the bolt and the driven-side rotating body or the cam shaft abut each other in a direction orthogonal to an axial direction of the bolt in a region between the sprocket and the male screw section in the direction of the rotational axis.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, the embodiments disclosed here will be described with reference to the drawings.

First Embodiment

FIGS. 1 to 4 illustrate a valve opening and closing timing control device according to the embodiment.

The valve opening and closing timing control device changes a relative rotational phase of an outer rotor 1 and an inner rotor 2 by controlling a flow path of engine oil (an example of a hydraulic fluid) by an electromagnetic control valve 10, and then controls opening and closing timing of an intake valve in an engine for a vehicle.

In the valve opening and closing timing control device, a relationship between a crankshaft E1 and an intake cam shaft 3 is set such that an intake compression ratio is enhanced with an increase in a displacement amount when the relative rotational phase is displaced in an advance angle direction S1 and the intake compression ratio is reduced with the increase in the displacement amount when the relative rotational phase is displaced in a retarded angle direction S2.

In addition, the valve opening and closing timing control device may control opening and closing timing of an exhaust valve.

Figure 1:
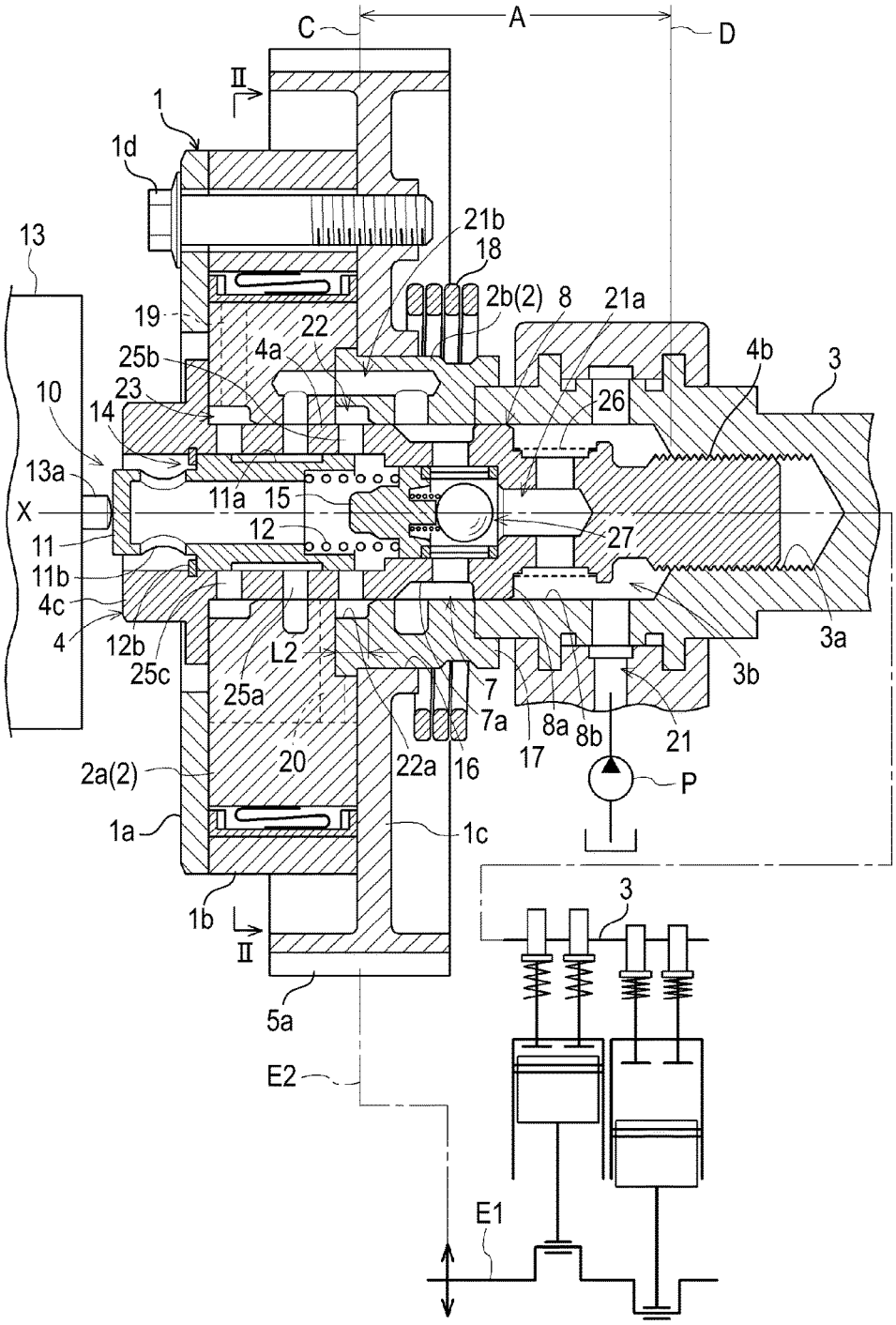
FIG. 1 is a sectional view illustrating an entire configuration of a valve opening and closing timing control device.
Figure 2:
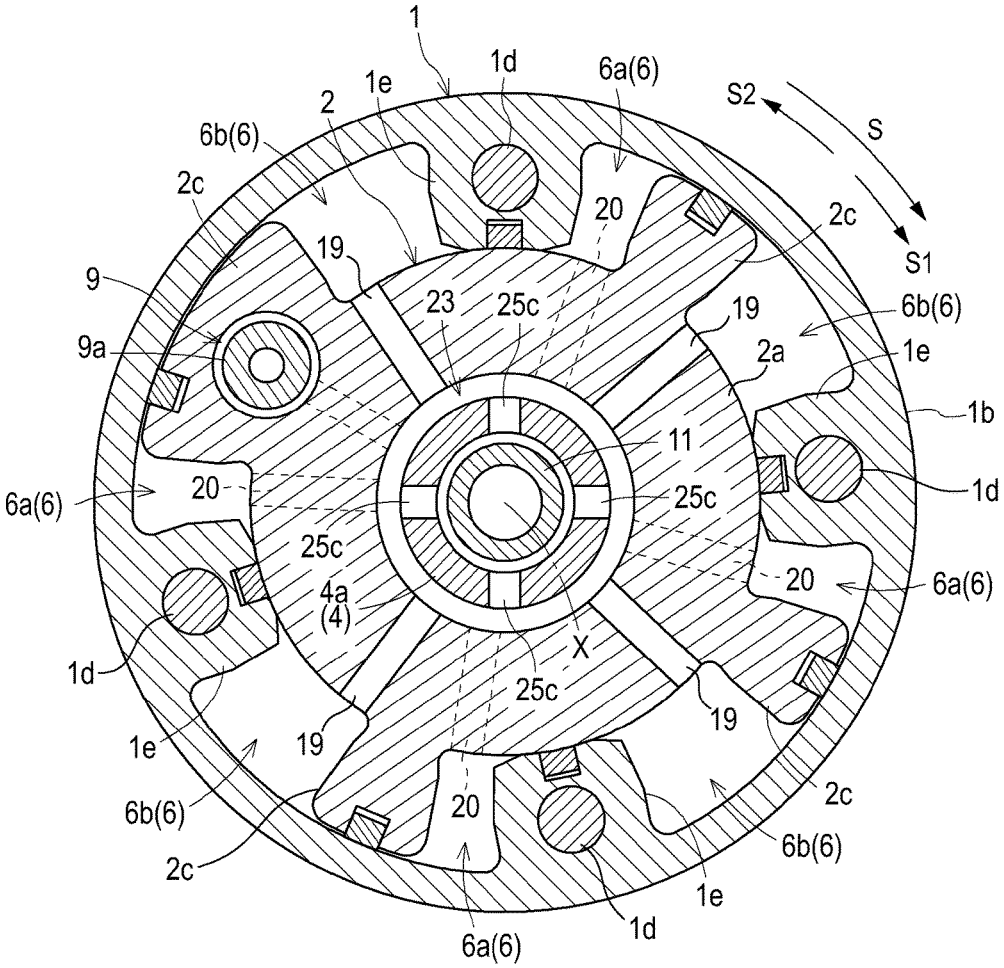
FIG. 2 is a sectional view that is taken along line II-II in FIG. 1.
Figure 3:
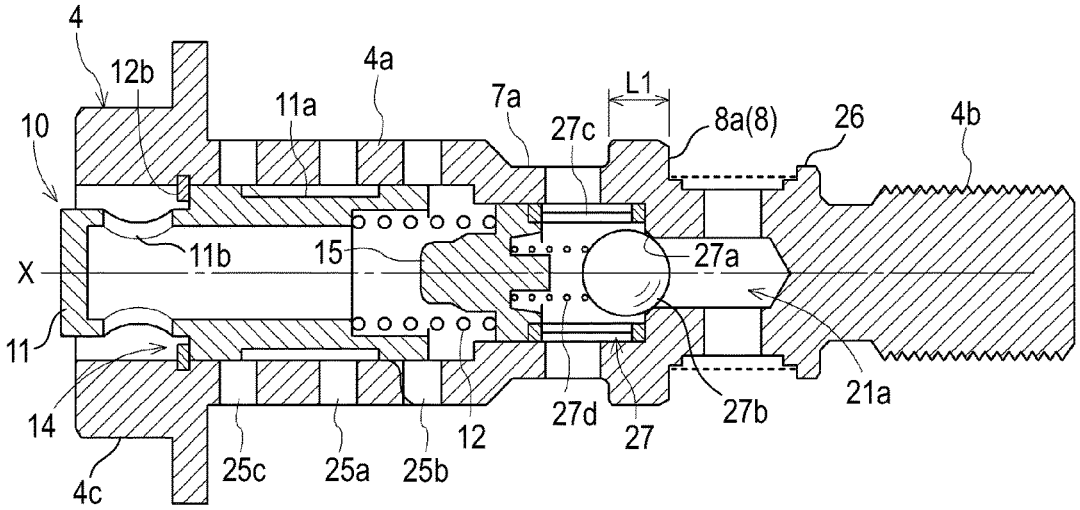
FIG. 3 is an enlarged sectional view of an OCV bolt.
Figure 4:
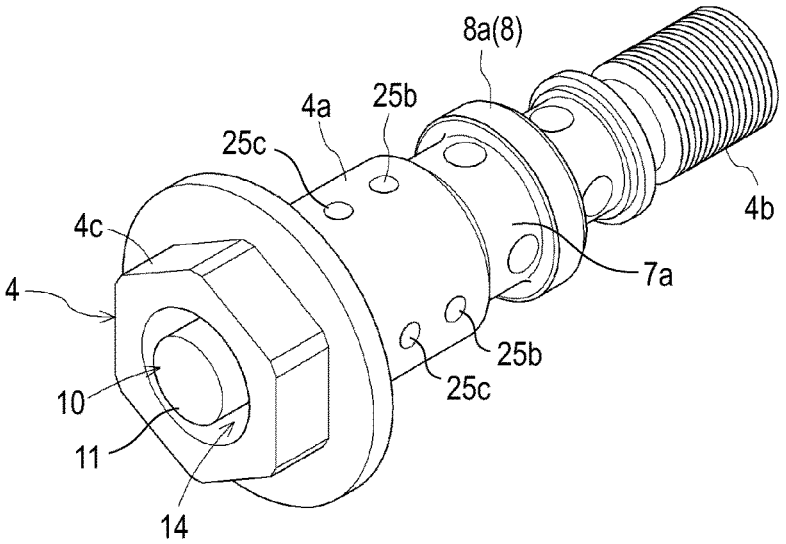
FIG. 4 is a perspective view of the OCV bolt.

As illustrated in FIGS. 1 to 3, the valve opening and closing timing control device includes the outer rotor 1 that is, for example, made of aluminum alloy and rotates in synchronization with the crankshaft E1 of the engine for the vehicle, the inner rotor 2 that is supported by an inside of the outer rotor 1 to be rotatable about a rotational axis X and integrally rotates with the intake valve opening and closing cam shaft 3 of the engine, and a connecting bolt 4 that is made of steel and is inserted into the inner rotor 2 for fixing the inner rotor 2 to the cam shaft 3.

The inner rotor 2 includes an inner rotor body 2*a* that is made of aluminum alloy and a cylindrical adapter 2*b* that is made of steel and transmits rotation of the inner rotor body 2*a*.

Rotation of each of the inner rotor body 2*a* and the adapter 2*b*, and rotation of each of the adapter 2*b* and the cam shaft 3 are stopped by a key fitted to joint surfaces thereof.

Furthermore, a material of the outer rotor 1 and the inner rotor body 2*a* is not limited to aluminum alloy and, for example, may be formed of various types of metal materials such as steel. In addition, a material of the adapter 2*b* is not limited to steel and, for example, may be formed of various types of metal materials such as aluminum alloy.

The inner rotor body 2*a* and the adapter 2*b* are fitted to each other in the direction of the rotational axis X and are supported to be relatively rotatable with respect to the outer rotor 1.

The connecting bolt 4 passes through the adapter 2*b* from the inner rotor body 2*a* side, coaxially fastens, and fixes the inner rotor body 2*a*, the adapter 2*b*, and the cam shaft 3.

The engine for the vehicle corresponds to "the internal combustion engine", the crankshaft E1 corresponds to "the driving shaft of the internal combustion engine", the outer rotor 1 corresponds to "the driving-side rotating body", and the inner rotor 2 corresponds to "the driven-side rotating body".

The connecting bolt 4 includes a fitting shaft section 4*a* that is fitted in the inner rotor body 2*a*, the adapter 2*b*, and the cam shaft 3 coaxially with the rotational axis X, and a male screw section 4*b* that engages with a female screw section 3*a* formed in a bolt hole 8*b* of the cam shaft 3.

The cam shaft 3 is a rotation shaft of a cam (not illustrated) for controlling opening and closing of the intake valve of the engine and rotates in synchronization with the inner rotor body 2*a*, the adapter 2*b*, and the connecting bolt 4. The cam shaft 3 is assembled to a cylinder head of the engine (not illustrated) to be rotatable.

Outer Rotor and Inner Rotor

The outer rotor 1 is configured to integrally connect a front plate 1*a* that is provided on a side opposite to the side of the cam shaft 3, an outer rotor body 1*b* that is externally mounted on the inner rotor body 2*a*, and a rear plate 1*c* that integrally includes a timing sprocket 5 with a fastening bolt 1*d*.

The timing sprocket 5 includes a tooth section 5*a* having a wide width and an endless rotating body E2 such as a toothed rubber belt interlocked to the crankshaft E1 is wound around the timing sprocket 5.

Moreover, the timing sprocket 5 may be formed in a flat shape around which a metal chain is wound.

If the crankshaft E1 is driven to rotate, a rotational power is transmitted to the timing sprocket 5 by the endless rotating body E2 and the outer rotor 1 is driven to rotate in a rotating direction S illustrated in FIG. 2.

According to driving of the outer rotor 1 to rotate, the inner rotor 2 is driven to rotate in the rotating direction S, the cam shaft 3 rotates, the cam provided in the cam shaft 3 depresses the intake valve of the engine, and then the valve is opened.

A circular first circumferential groove 7*a*, which configures a first annular flow path 7 for supplying and discharging oil with respect to a fluid pressure chamber 6 described below, between the adapter 2*b* and the first circumferential groove 7*a*, is formed in an outer periphery portion of the fitting shaft section 4*a*.

In the embodiment, the first circumferential groove 7*a* is formed to allow oil to flow into the fluid pressure chamber 6, but the first circumferential groove 7*a* may be formed to allow oil to flow out from the fluid pressure chamber 6.

The outer rotor 1 and the inner rotor 2 on the inside of the outer rotor 1 are rotated by driving of the timing sprocket 5 by the rotation of the endless rotating body E2. Thus, the outer rotor 1 and the inner rotor 2 are pulled toward the crankshaft E1. Thus, as illustrated in FIG. 1, a bending force acts on a region A between the center C of the tooth section 5*a* of the timing sprocket 5 in a width direction and an end portion D of an engagement portion of the male screw section 4*b* with the female screw section 3*a*.

In the embodiment, an abutting section 8 at which the connecting bolt 4 and the cam shaft 3 abut to each other in a radial direction of the bolt, that is, in a direction orthogonal to an axial direction of the connecting bolt 4 is provided in the region A.

The abutting section 8 is configured such that a first portion 8*a* that is disposed on a rear side of the first circumferential groove 7*a* in an inserting direction with respect to the inner rotor body 2*a* of the connecting bolt 4 and an inner peripheral surface of the bolt hole 8*b* formed in the cam shaft 3 abut to each other in the radial direction of the bolt in the fitting shaft section 4*a*.

Thus, when the driven-side rotating body 2 is pulled toward the crankshaft E1, the connecting bolt 4 and the cam shaft 3 abut each other in the radial direction of the bolt in the region A and it is possible to enhance the rigidity of an assembled connecting bolt 4, the driven-side rotating body 2, and the cam shaft 3.

Thus, particularly, it is possible to reduce the displacement amount of the connecting bolt 4 and to maintain smooth rotation of the outer rotor 1 and the inner rotor 2 over a long period of time.

As illustrated in FIG. 2, the inner rotor body 2*a* is accommodated in the outer rotor 1 and the fluid pressure chamber 6 is formed to be partitioned between the outer rotor 1 and the inner rotor body 2*a*.

The fluid pressure chamber 6 is formed between the inner rotor body 2*a* and the outer rotor body 1*b* by forming a plurality of protrusion sections 1*e* protruding inwardly in the radial direction in the outer rotor body 1*b* with gaps in the rotating direction S.

The fluid pressure chamber 6 is partitioned into an advance angle chamber 6*a* and a retarded angle chamber 6*b* in the rotating direction S by a vane section 2*c* formed in a portion of the outer peripheral surface of the inner rotor body 2*a* which faces the fluid pressure chamber 6.

The pressure of hydraulic oil acts on the vane section 2*c* by supplying, discharging, or blocking supply or discharge of oil to the advance angle chamber 6*a* and the retarded angle chamber 6*b* as the hydraulic fluid. Thus, the relative rotational phase is displaced in an advance angle direction or a retarded angle direction, or is maintained in any phase.

As indicated by arrow S1 in FIG. 2, the advance angle direction is a direction in which a volume of the advance angle chamber 6*a* is increased. As indicated by arrow S2 in FIG. 2, the retarded angle direction is a direction in which a volume of the retarded angle chamber 6*b* is increased. The relative rotational phase when the volume of the advance angle chamber 6*a* becomes the maximum is the most advance angle phase and the relative rotational phase when the volume of the retarded angle chamber 6*b* becomes the maximum is the most retarded angle phase.

As illustrated in FIG. 2, a lock mechanism 9 is provided which is capable of constraining the relative rotational phase of the inner rotor body 2*a* with respect to the outer rotor 1 to a predetermined lock phase between the most advance angle phase and the most retarded angle phase by constraining a relatively rotating movement of the inner rotor body 2*a* with respect to the outer rotor 1.

The lock mechanism 9 constrains the relative rotational phase to the lock phase of a lock member 9*a* extending and retracting by fitting the lock member 9*a,* which advances and is retracted in the direction of the rotational axis X by the operation of the hydraulic oil, to the front plate 1*a* or the rear plate 1*c*.

Electromagnetic Control Valve

In the embodiment, the electromagnetic control valve 10 as "the control valve" is disposed coaxially with the cam shaft 3.

The electromagnetic control valve 10 switches supply and discharge of oil with respect to the fluid pressure chamber 6 such that the relative rotational phase of the inner rotor body 2*a* with respect to the outer rotor 1 is changed between the most advance angle phase and the most retarded angle phase.

The electromagnetic control valve 10 includes a cylindrical spool 11, a spool spring 12 that biases the spool 11, an electromagnetic solenoid 13 that drives the spool 11 against a biasing force of the spool spring 12, and a stopper 12*b* that prevents the spool 11 from escaping in the axial direction.

The spool 11 includes a drain hole 11*b* and is accommodated in a spool chamber 14, which is formed so as to open on a bolt head section 4*c* side on the inside of the connecting bolt 4, to be slidable in the direction of the rotational axis X.

The inner rotor body 2*a* and the adapter 2*b* are fastened and fixed to the cam shaft 3 by screwing the male screw section 4*b* of the connecting bolt 4 into the female screw section 3*a* formed in the bolt hole 8*b* of the cam shaft 3.

The spool spring 12 mounted between a spring receiver 15 provided on a rear side of the spool chamber 14 and the spool 11 is always biased on a side on which the spool 11 protrudes from the spool chamber 14.

If power is supplied to the electromagnetic solenoid 13, a push pin 13*a* provided in the electromagnetic solenoid 13 presses the spool 11 and the spool 11 slides on the cam shaft 3 side against the biasing force of the spool spring 12.

The electromagnetic control valve 10 is configured such that the position of the spool 11 can be adjusted by adjusting a duty ratio of power supplied to the electromagnetic solenoid 13. A power supplying amount to the electromagnetic solenoid 13 is controlled by an electronic control unit (ECU) (not illustrated).

Adapter

The adapter 2*b* is formed in a cylinder shape and integrally includes a circumferential wall section 17, which fits and passes through a fitting hole 16 passing through the rear plate 1*c* to be relatively rotated, and externally fits to the outer peripheral surface of the cam shaft 3 on the outer periphery side of an end portion that protrudes from the fitting hole 16 and abuts the end surface of the cam shaft 3.

A torsion spring 18 biasing the inner rotor body 2*a* with respect to the outer rotor 1 in the advance angle direction S1 is fastened over the adapter 2*b* and the rear plate 1*c*.

Flow Path Configuration

A second annular flow path 22 is formed at a position on a front side of the first annular flow path 7 in the inserting direction with respect to the adapter 2*b* of the connecting bolt 4 between an inner periphery portion of the adapter 2*b* and an outer periphery portion of the fitting shaft section 4*a*. Furthermore, a third annular flow path 23 is formed between the inner periphery portion of the inner rotor body 2*a* on the front side and the outer periphery portion of the fitting shaft section 4*a*.

An advance angle flow path 20 communicating with the advance angle chamber 6*a* and a retarded angle flow path 19 communicating with the retarded angle chamber 6*b* are formed in the inner rotor body 2*a*. The advance angle flow path 20 communicates with the second annular flow path 22 and the retarded angle flow path 19 communicates with the third annular flow path 23.

A supply flow path 21 for selectively supplying oil discharged from an oil pump P to the advance angle flow path 20 or the retarded angle flow path 19 is provided over the cam shaft 3, the connecting bolt 4, and the adapter 2*b*.

As illustrated in FIG. 3, a pump port 25*a* that communicates with the first annular flow path 7 through a second flow path 21*b* along the direction of the rotational axis X, an advance angle port 25*b* that communicates with the second annular flow path 22, and a retarded angle port 25*c* that communicates with the third annular flow path 23 are formed in the connecting bolt 4.

The supply flow path 21 includes a first flow path 21*a* that is formed on the inside of the connecting bolt 4 such that a bolt outer periphery flow path 3*b* formed to surround the outer periphery side of the connecting bolt 4 in the bolt hole 8*b* of the cam shaft 3 communicates with the first annular flow path 7, the second flow path 21*b* that is formed on the inside of the inner rotor body 2*a* and the adapter 2*b* such that the first annular flow path 7 communicates with the pump port 25*a,* and a groove section 11*a* that is formed in the spool 11 such that the pump port 25*a* selectively communicates with the advance angle port 25*b* or the retarded angle port 25*c*.

An opening section facing the bolt outer periphery flow path 3*b* of the first flow path 21 a is provided with a filter section 26 of oil flowing into the first flow path 21*a*.

FIG. 1 illustrates the spool 11 in a state where the pump port 25*a* and the retarded angle port 25*c* communicate with each other through the groove section 11*a,* and the advance angle port 25*b* moves to a retarded angle position communicating with the inside of the spool 11.

In this state, oil is supplied to the retarded angle chamber 6*b* through the retarded angle port 25*c,* the third annular flow path 23, and the retarded angle flow path 19 (see FIG. 2), oil of the advance angle chamber 6*a* is discharged from the spool chamber 14 to the oil pan through the advance angle flow path 20, the second annular flow path 22, the advance angle port 25*b,* and the drain hole 11*b*, and the relative rotational phase is changed in the retarded angle direction.

Even though not illustrated, by the operation of the electromagnetic solenoid 13, the spool 11 can be switched to a state of moving to a neutral position in which the groove section 11*a* only communicates with the pump port 25*a* and does not communicate with either of the advance angle port 25*b* and the retarded angle port 25*c*.

In this state, supply and discharge of oil with respect to the advance angle chamber 6*a* and the retarded angle chamber 6*b* are stopped and the relative rotational phase is not changed.

Furthermore, even though not illustrated, by the operation of the electromagnetic solenoid 13, the spool 11 can be switched to a state of moving to an advance angle position in which the pump port 25*a* and the advance angle port 25*b* communicate with each other through the groove section 11*a*, and the retarded angle port 25*c* communicates with the spool chamber 14.

In this state, oil is supplied to the advance angle chamber 6*a* through the advance angle port 25*b*, the second annular flow path 22, and the advance angle flow path 20, oil of the retarded angle chamber 6*b* is discharged from the spool chamber 14 to the oil pan through the retarded angle flow path 19, the third annular flow path 23, and the retarded angle port 25*c*, and the relative rotational phase is changed in the retarded angle direction.

A check valve 27 is provided in a middle portion of the first flow path 21*a* on the inside of the fitting shaft section 4*a* such that if a supply pressure of oil is a set pressure or less, flow of oil into the first annular flow path 7 is blocked and backflow of oil from the first annular flow path 7 is prevented, and if the supply pressure of oil exceeds the set pressure, flow of oil into the first annular flow path 7 is allowed.

As illustrated in FIG. 3, the check valve 27 includes a valve seat 27*a* that is annularly formed in a middle portion of the first flow path 21*a* and a ball valve body 27*b* that closes the middle portion of the first flow path 21*a*.

The ball valve body 27*b* is accommodated in a perforated cylindrical holder 27*c* mounted on the rear side of the spring receiver 15 of the spool chamber 14 to be movable in the direction of the rotational axis X and is always biased so as to be pressed to the valve seat 27*a* by a spring 27*d* mounted between the spring receiver 15 and the ball valve body 27*b*.

The valve seat 27*a* is formed on the inside of the first portion 8*a* in the radial direction of the shaft.

As described above, since the valve seat 27*a* is formed in the first portion 8*a* having a large bending rigidity, it is possible to prevent a diameter of the valve seat 27*a* from increasing by the repeated abutting of the ball valve body 27*b* to the valve seat 27*a* and to satisfactorily maintain a check function of the check valve 27 over a long period of time.

A second circumferential groove 22*a* configuring the second annular flow path 22 is formed in a second portion on the front side of the first annular flow path 7 in the inserting direction to the inner rotor body 2*a* of the fitting shaft section 4*a* in the inner periphery portion of the adapter 2*b* to which the fitting shaft section 4*a* is fitted.

Thus, the second circumferential groove 22*a* is formed to allow oil to flow into the fluid pressure chamber 6 or to flow out from the fluid pressure chamber 6.

An axial length L1 (see FIG. 3) of the first portion 8*a* is set to be longer than a groove width L2 (see FIG. 1) of the second circumferential groove 22*a*.

Thus, when the fitting shaft section 4*a* passes through the inner periphery portion of the driven-side rotating body 2 to cause the male screw section 4*b* of the connecting bolt 4 to engage with the cam shaft 3, there is no concern that the first portion 8*a* is caught by entering the second circumferential groove 22*a* and it is possible to achieve efficiency improvement of a fixing operation of the driven-side rotating body 2 and the cam shaft 3 by the connecting bolt 4.

Second Embodiment

Figure 5:
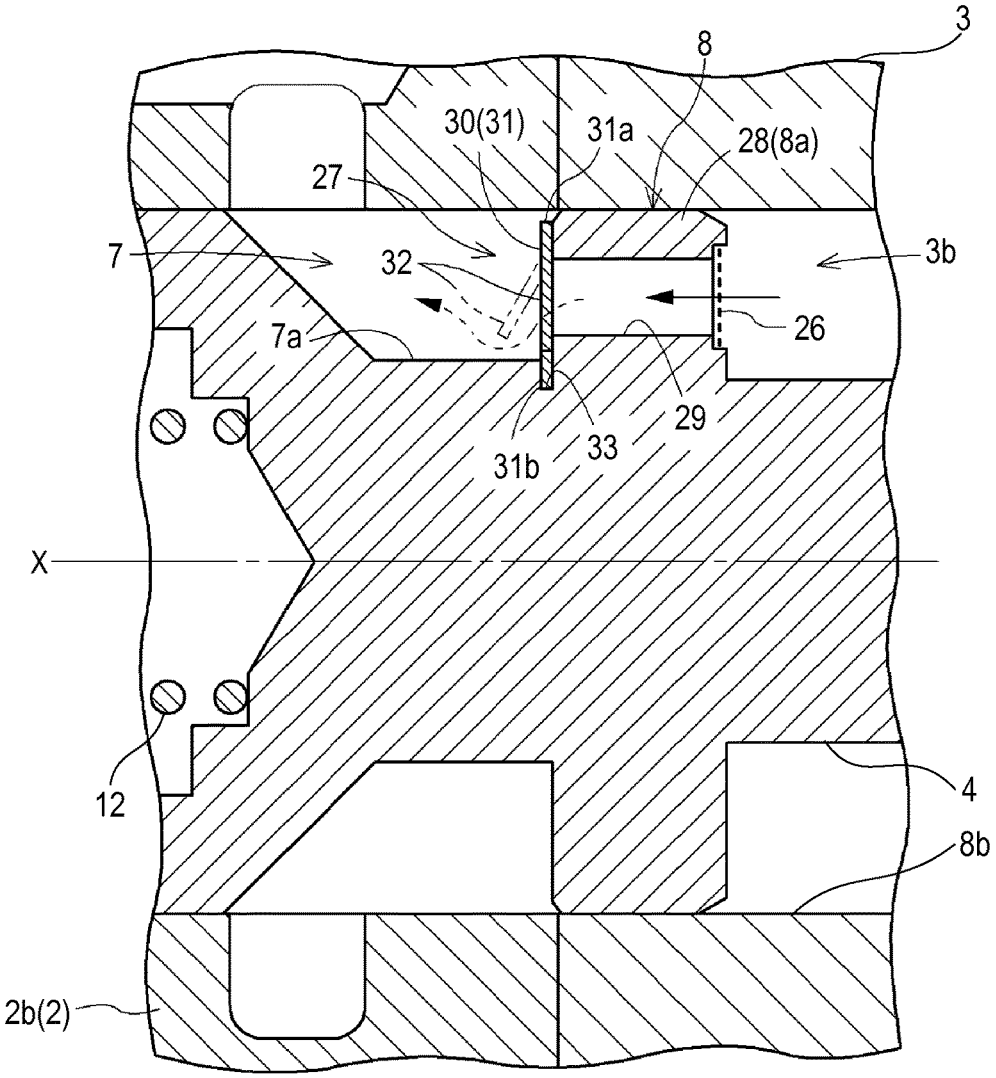
FIG. 5 is a sectional view illustrating a check valve in a second embodiment.
Figure 6:
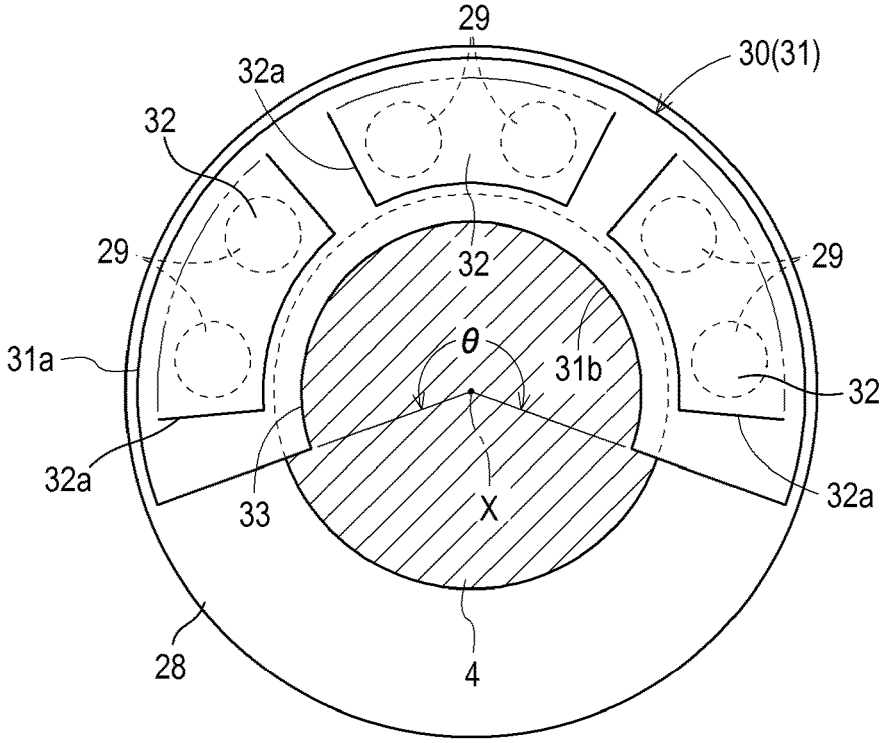
FIG. 6 is a front view illustrating the check valve in the second embodiment.
Figure 7:
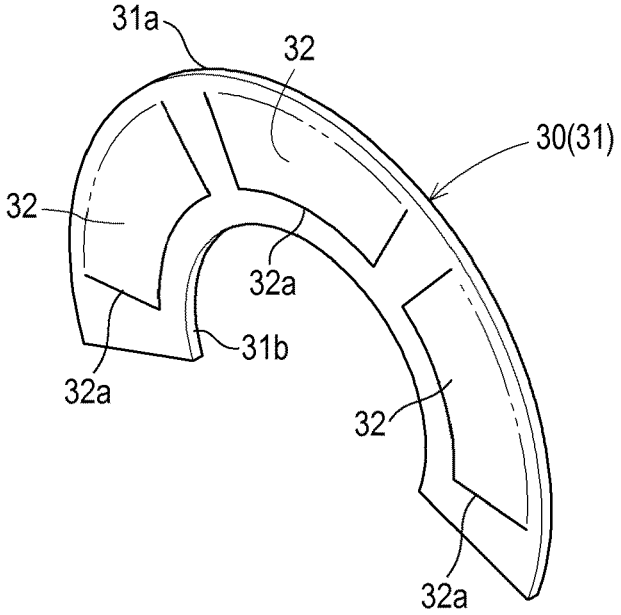
FIG. 7 is a perspective view of a plate-shaped valve unit.

FIGS. 5 to 7 illustrate main portions of a valve opening and closing timing control device of a second embodiment.

In the embodiment, configurations of a check valve 27 supplying oil to a first circumferential groove 7*a* in a direction along a rotational axis X and a filter section 26 of oil flowing into the check valve 27 are different from those of the first embodiment and other configurations are the same as those of the first embodiment.

The check valve 27 and the filter section 26 are provided in a flange portion 28 that protrudes in a circular ring shape toward an inner peripheral surface of a bolt hole 8*b* of a cam shaft 3 in a first portion 8*a*.

The check valve 27 is configured to include a plurality of flow-in paths 29 in a circumferential direction which are formed in the flange portion 28 and in which oil flows from the cam shaft 3 side to a first annular flow path 7 and a plate-shaped valve unit 30 that is made of resin and is mounted on a side surface of the flange portion 28 facing the first circumferential groove 7*a* by coming into close contact with the side surface.

The filter section 26 is mounted for covering an inlet of the flow-in path 29 of the flange portion 28 on the cam shaft 3 side.

The plate-shaped valve unit 30 integrally includes three check valve bodies 32 in a fan-shaped plate 31 made of resin in the circumferential direction of the flange portion 28. The number of the check valve bodies 32 may be a number of other than three.

The fan-shaped plate 31 includes an outer peripheral edge 31*a* having a diameter smaller than an outer diameter of the flange portion 28 and an inner peripheral edge 31*b* having a diameter smaller than a diameter in a groove bottom surface of the first circumferential groove 7*a*. As illustrated in FIG. 6, the fan-shaped plate 31 is formed in a fan form of a C shape in a front view in which a center angle θ exceeds 180 degrees, fits the inner peripheral edge 31*b* into a fitting groove 33 formed in the connecting bolt 4, and is fixed to the side surface of the flange portion 28 by coming into close contact with the side surface.

The check valve body 32 forms a notch 32*a* of a U-shape in the fan-shaped plate 31 and is configured by an inside portion of the notch 32*a*.

If the pressure of oil flowing into the flow-in path 29 is a set pressure or less, the check valve body 32 blocks flowing of oil into the first annular flow path 7 by closing the flow-in path 29 and prevents backflow of oil flowing into the first annular flow path 7.

Furthermore, if the pressure of oil flowing into the flow-in path 29 exceeds the set pressure, the check valve body 32 is elastically deformed so as to be separated from the flange portion 28 and allows oil to flow into the first annular flow path 7 through the flow-in path 29.

The filter section 26 is mounted on the side surface of the flange portion 28 on the cam shaft 3 side to cover an inlet of the flow-in path 29.

In the embodiment, since it is not necessary to provide the check valve 27, a flow path introducing oil into the check valve 27, and the like on the inside of the connecting bolt 4, it is possible to reduce a size of the valve opening and closing timing control device by shortening the length of the connecting bolt 4.

Third Embodiment

Figure 8:
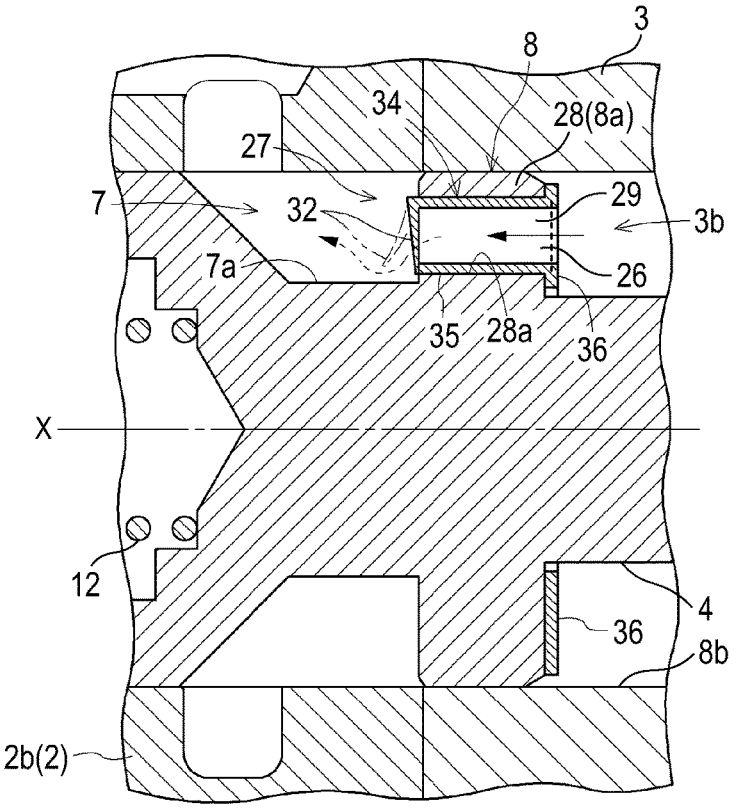
FIG. 8 is a sectional view illustrating a check valve in a third embodiment.
Figure 9:
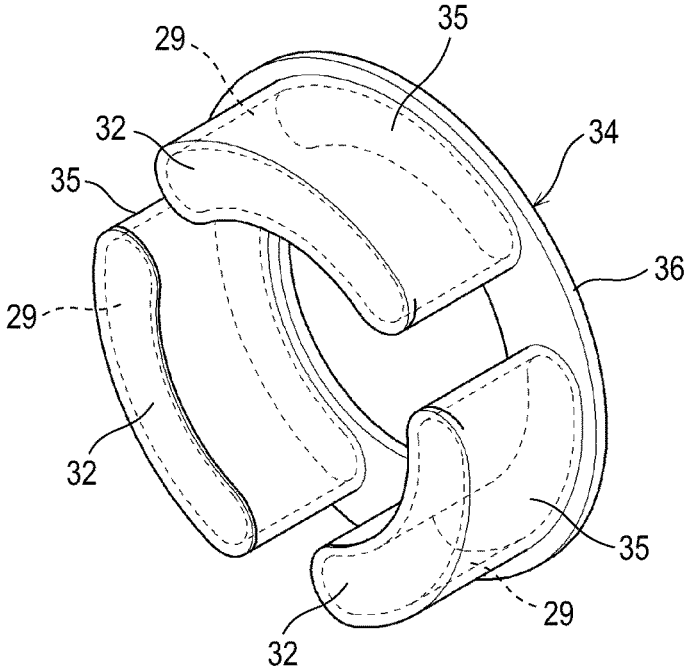
FIG. 9 is a perspective view of a valve unit in the third embodiment.

FIGS. 8 and 9 illustrate main portions of a valve opening and closing timing control device of a third embodiment.

In the embodiment, configurations of a check valve 27 supplying oil to a first circumferential groove 7*a* in a direction along a rotational axis X and a filter section 26 of oil flowing into the check valve 27 are different from those of the first embodiment and other configurations are the same as those of the first embodiment.

The check valve 27 and the filter section 26 are integrally provided in a valve unit 34 that is made of resin and is assembled to a first portion 8*a*. The valve unit 34 is formed in a circular shape around a rotational axis X and is assembled by being mounted on a flange portion 28 protruding in a circular ring shape toward an inner peripheral surface of a bolt hole 8*b* of a cam shaft 3 from a bolt leading end side in the first portion 8*a*.

The valve unit 34 is configured by integrally molding three cylindrical portions 35 that are arranged at equal intervals in a circumferential direction, an annular base plate portion 36 that connects outer peripheries of the cylindrical portions 35 to each other in one end side thereof, and a check valve body 32 that closes the other end side of each of the cylindrical portions 35 to be openable and closable. The cylindrical portions 35 may be other than three.

The check valve body 32 is continuously provided in a cylindrical wall portion on a side closer to the cam shaft 3 in a cantilever type in the cylindrical portion 35.

An inside of the cylindrical portion 35 configures a flow-in path 29 through which oil flows from the cam shaft 3 side into the first circumferential groove 7*a*.

The valve unit 34 is fixed to the flange portion 28 by fitting each of the cylindrical portions 35 into a valve body mounting through hole 28*a* formed in the flange portion 28 from the direction of the rotational axis X and the check valve body 32 is mounted on a side surface facing the first circumferential groove 7*a* of the flange portion 28.

The valve body mounting through hole 28*a* is an arc shape that is long in a circumferential direction when viewed in a direction along the rotational axis X and an end portion thereof in the circumferential direction is formed in a semi-circular long hole shape.

The cylindrical portion 35 is fitted into the valve body mounting through hole 28*a* in the direction of the rotational axis X and thereby the outer peripheral surface is formed in a shape coming into close contact with the inner peripheral surface of the valve body mounting through hole 28*a* over the entire periphery.

If the pressure of oil flowing into the cylindrical portion 35 is a set pressure or less, the check valve body 32 closes the cylindrical portion 35, blocks flow of oil into the first annular flow path 7, and simultaneously prevents backflow of oil flowing into the first annular flow path 7.

Furthermore, if the pressure of oil flowing into the cylindrical portion 35 exceeds the set pressure, the check valve body 32 is elastically deformed to be separated from the cylindrical portion 35 and allows flow of oil into the first annular flow path 7 through the cylindrical portion 35.

The filter section 26 is insert-molded in one end side of each of the cylindrical portions 35 and is mounted on a side surface of the flange portion 28 on the cam shaft 3 side.

In the embodiment, similar to the second embodiment, since it is not necessary to provide the check valve 27, a flow path for introducing oil into the check valve 27, and the like on the inside of the connecting bolt 4, it is possible to reduce a size of the valve opening and closing timing control device by shortening the length of the connecting bolt 4.

In an aspect, a valve opening and closing timing control device according to this disclosure includes a driving-side rotating body that includes a sprocket around which a rotating body interlocked with a driving shaft of an internal combustion engine is wound and rotates in synchronization with the driving shaft; a driven-side rotating body that is supported by an inside of the driving-side rotating body to be rotatable coaxially with the same rotational axis and integrally rotates with a valve opening and closing cam shaft of the internal combustion engine; a bolt that is inserted into the driven-side rotating body to fix the driven-side rotating body to the cam shaft; a fluid pressure chamber that is formed by being partitioned between the driving-side rotating body and the driven-side rotating body; and a control valve that switches supplying and discharging of a hydraulic fluid with respect to the fluid pressure chamber such that a relative rotational phase of the driven-side rotating body with respect to the driving-side rotating body is changed between the most advance angle phase and the most retarded angle phase, in which the bolt includes a male screw section in which the bolt engages with the cam shaft, and an abutting section at which the bolt and the driven-side rotating body or the cam shaft abut each other in a direction orthogonal to an axial direction of the bolt in a region between the sprocket and the male screw section in the direction of the rotational axis.

The valve opening and closing timing control device of this configuration is provided with the abutting section at which the bolt and the driven-side rotating body or the cam shaft abut each other in the direction orthogonal to the axial direction of the bolt in the region between the sprocket and the male screw section in the direction of the rotational axis.

Thus, it is possible to enhance rigidity of an assembly of the bolt, the driven-side rotating body, and the cam shaft by causing the bolt and the driven-side rotating body, or the cam shaft to abut each other in the direction orthogonal to the axial direction of the bolt in the region between the sprocket and the male screw section in the direction of the rotational axis when the driven-side rotating body is pulled toward the driving shaft.

Therefore, according to the valve opening and closing timing control device of this configuration, particularly, a deformation amount of the bolt decreases and a smooth rotation of the driving-side rotating body and the driven-side rotating body can be maintained over a long period of time.

In another aspect, a first circumferential groove that allows the hydraulic fluid to flow into the fluid pressure chamber or to flow out from the fluid pressure chamber is formed in an outer periphery portion of the bolt, and the abutting section is configured of a first portion that is disposed on a rear side further than the first circumferential groove in an inserting direction in the driven-side rotating body in the bolt, the driven-side rotating body, or the cam shaft.

In this configuration, if the first circumferential groove is formed in the outer periphery portion of the bolt in the vicinity of the rotational axis and the first portion abutting the driven-side rotating body or the cam shaft in the direction orthogonal to the axial direction of the bolt is provided, processing of the first circumferential groove is facilitated. Furthermore, it is possible to efficiently prevent deterioration of a bending rigidity of the driven-side rotating body or the cam shaft farther from rotation axes than the bolt.

In still another aspect, a second circumferential groove that allows the hydraulic fluid to flow into the fluid pressure chamber or to flow out from the fluid pressure chamber is formed in a second portion on a front side of the first circumferential groove in the inserting direction in the inner periphery portion with which the bolt of the driven-side rotating body engages, and the length of the first portion in an axial direction is longer than a groove width of the second circumferential groove.

In this configuration, when the male screw section of the bolt is inserted into the inner periphery portion of the driven-side rotating body so as to engage with the cam shaft, there is no concern that the first portion enters the second circumferential groove and it is possible to achieve improvement in efficiency in fixing work of the driven-side rotating body and the cam shaft by the bolt.

In yet another aspect, a check valve that includes a valve body moving in the direction of the rotational axis and prevents backflow of the hydraulic fluid from the first circumferential groove is provided on an inside of the bolt, and a valve seat of the valve body is formed on an inside of the first portion in a radial direction of a shaft.

In this configuration, if the valve seat of the valve body is formed on the inside of the first portion in the radial direction of the shaft, of which the bending rigidity is greater than a portion in which the first circumferential groove is formed, it is possible to prevent a diameter of the valve seat from increasing by the repeated abutting of the valve body to the valve seat and to satisfactorily maintain a checking function of the check valve over a long period of time.

In still yet another aspect, a check valve that supplies the hydraulic fluid with respect to the first circumferential groove in a direction along the rotational axis includes a flow-in path which is formed in the first portion and through which the hydraulic fluid flows from the cam shaft side into the first circumferential groove, a valve body that is mounted on a side surface facing the first circumferential groove of the first portion and is operated to open the flow-in path by the pressure of the hydraulic fluid that flows into the flow-in path, and a filter section that is mounted on a side surface on the cam shaft side of the first portion.

In the valve opening and closing timing control device of this configuration, the annular valve body is mounted on the side surface facing the first circumferential groove of the first portion. Thus, the check valve including the valve body that is operated to open the flow-in path formed in the first portion by the pressure of the hydraulic fluid that flows into the flow-in path is provided and the filter section is mounted on the side surface on the cam shaft side of the first portion.

Thus, in this configuration, a check valve for controlling flow of the hydraulic fluid is not necessary to be provided on the inside of the bolt and the check valve preventing backflow of the hydraulic fluid from the first circumferential groove and the filter section are compactly assembled in the first portion. Thus, it is possible to reduce the size of the device.

In a further aspect, the valve opening and closing timing control device further includes a valve unit that is assembled to the first portion, in which the valve body and the filter section are provided in the valve unit.

In this configuration, it is possible to easily assemble the valve body and the filter section to the first portion with assembling work of the valve unit to the first portion and it is possible to reduce manufacturing costs.

Other Embodiments

1. The valve opening and closing timing control device of the embodiment disclosed here may have the driven-side rotating body that does not include an adapter.

2. The valve opening and closing timing control device of the embodiment disclosed here may have an abutting section at which the bolt and the driven-side rotating body or the adapter abut each other in the radial direction of the bolt in the region between the sprocket and the male screw section in the direction of the rotational axis.

The invention can be used in the valve opening and closing timing control device that is mounted on the internal combustion engine for various applications other than the vehicle.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control device comprising:

a driving-side rotating body that includes a sprocket around which a rotating body interlocked with a driving shaft of an internal combustion engine is wound and rotates in synchronization with the driving shaft;

a driven-side rotating body that is supported by an inside of the driving-side rotating body to be rotatable coaxially with a same rotational axis and integrally rotates with a valve opening and closing cam shaft of the internal combustion engine;

a bolt that is inserted into the driven-side rotating body to fix the driven-side rotating body to the cam shaft;

a fluid pressure chamber that is formed by being partitioned between the driving-side rotating body and the driven-side rotating body; and a control valve that switches supplying and discharging of a hydraulic fluid with respect to the fluid pressure chamber such that a relative rotational phase of the driven-side rotating body with respect to the driving-side rotating body is changed between a most advance angle phase and a most retarded angle phase, wherein the bolt includes a male screw section in which the bolt engages with the cam shaft, and an abutting section at which a first portion of the bolt and the driven-side rotating body or the cam shaft abut each other in a direction orthogonal to an axial direction of the bolt in a region between the sprocket and the male screw section in a direction of the rotational axis;

wherein a first circumferential groove that allows the hydraulic fluid to flow into the fluid pressure chamber or to flow out from the fluid pressure chamber is formed in an outer periphery portion of the bolt, wherein the first portion is disposed on a rear side of the first circumferential groove in an inserting direction of the bolt with respect to the driven-side rotating body, wherein a second circumferential groove that allows the hydraulic fluid to flow into the fluid pressure chamber or to flow out from the fluid pressure chamber is formed in a second portion which is provided in an inner periphery portion of the driven-side rotating body with which the bolt engages, the second portion being disposed on a front side of the first circumferential groove in the inserting direction, and wherein a length of the abutting section in the axial direction is longer than a groove width of the second circumferential groove.

2. The valve opening and closing timing control device according to claim 1, wherein a check valve that includes a valve body moving in the direction of the rotational axis and prevents backflow of the hydraulic fluid from the first circumferential groove is provided on an inside of the bolt, and wherein a valve seat of the valve body is formed on an inside of the first portion in a radial direction of a shaft.

3. The valve opening and closing timing control device according to claim 1, wherein a check valve that supplies the hydraulic fluid with respect to the first circumferential groove in a direction along the rotational axis includes a flow-in path which is formed in the first portion and through which the hydraulic fluid flows from a cam shaft side into the first circumferential groove, a valve body that is mounted on a side surface facing the first circumferential groove of the first portion and is operated to open the flow-in path by a pressure of the hydraulic fluid flowed into the flow-in path, and a filter section that is mounted on a side surface on the cam shaft side of the first portion.

4. The valve opening and closing timing control device according to claim 3, further comprising:

a valve unit that is assembled to the first portion, wherein the valve body and the filter section are provided in the valve unit.

5. A valve opening and closing timing control device comprising:

a driving-side rotating body that includes a sprocket around which a rotating body interlocked with a driving shaft of an internal combustion engine is wound and rotates in synchronization with the driving shaft;

a driven-side rotating body that is supported by an inside of the driving-side rotating body to be rotatable coaxially with a same rotational axis and integrally rotates with a valve opening and closing cam shaft of the internal combustion engine;

a bolt that is inserted into the driven-side rotating body to fix the driven-side rotating body to the cam shaft;

a fluid pressure chamber that is formed by being partitioned between the driving-side rotating body and the driven-side rotating body; and a control valve that switches supplying and discharging of a hydraulic fluid with respect to the fluid pressure chamber such that a relative rotational phase of the driven-side rotating body with respect to the driving-side rotating body is changed between a most advance angle phase and a most retarded angle phase, wherein the bolt includes a male screw section in which the bolt engages with the cam shaft, and an abutting section at which a first portion of the bolt and the driven-side rotating body or the cam shaft abut each other in a direction orthogonal to an axial direction of the bolt in a region between the sprocket and the male screw section in a direction of the rotational axis, wherein a first circumferential groove that allows the hydraulic fluid to flow into the fluid pressure chamber or to flow out from the fluid pressure chamber is formed in an outer periphery portion of the bolt, wherein the first portion is disposed on a rear side of the first circumferential groove in an inserting direction of the bolt with respect to the driven-side rotating body, wherein a check valve that supplies the hydraulic fluid with respect to the first circumferential groove in a direction along the rotational axis includes a flow-in path which is formed in the abutting section and through which the hydraulic fluid flows from a cam shaft side into the first circumferential groove, a valve body that is mounted on a side surface facing the first circumferential groove of the first portion and is operated to open the flow-in path by a pressure of the hydraulic fluid flowed into the flow-in path, and a filter section that is mounted on a side surface on the cam shaft side of the first portion.

* * * * *